US005669319A

United States Patent [19]

Liang

[11] Patent Number: 5,669,319

[45] Date of Patent: Sep. 23, 1997

[54] VACUUM CLEANER FOR SEWING MACHINE

[76] Inventor: Xin Liang, 6002, rue St-Hubert, Montréal (Québec), Canada, H2S 2R7

[21] Appl. No.: 667,832

[22] Filed: Jun. 20, 1996

[51] Int. Cl.[6] ..... D05B 71/00; A47L 5/00; B08B 15/04

[52] U.S. Cl. ..... 112/282; 15/301

[58] Field of Search ..... 112/282, 280, 112/256, DIG. 1, DIG. 2; 165/122, 56, 126; 15/301, 405; 415/219.1; 454/49, 66, 63, 64, 196

[56] References Cited

U.S. PATENT DOCUMENTS

| | | | |
|---|---|---|---|
| 1,955,384 | 4/1934 | Herr | 112/282 X |
| 4,127,075 | 11/1978 | Adamski, Jr. et al. | 112/DIG. 1 X |
| 4,709,645 | 12/1987 | Jones et al. | 112/282 |
| 5,454,338 | 10/1995 | McEwen et al. | 112/282 |

*Primary Examiner*—Ismael Izaguirre
*Attorney, Agent, or Firm*—François Martineau

[57] ABSTRACT

A waste fabric and lint collector and a cut thread chute assembly for use with an overlock stitching type sewing machine, comprising a collector box, including a front wall, two opposite lateral side walls, and top and bottom walls, a large see-through window forming part of the front wall thereof. The collector box is pivotally mounted in a releasable fashion to the sewing machine frame, wherein the front portion of the trimmed fabric and lint outlet is substantially closed by the collector box. A tubular coupling member has an inner end portion of a shape complimentary to that of the top wall of the collector box, for releasable interlocking engagement therewith, and an outer end portion, for releasably coupling with a complementary flexible air suction conduit for discharge of the lint to a waste container. The chute consists of: an elongated tube, having an enlarged transversely opening mouth at one end, and a smaller axially opening outlet port at the opposite end. The chute is anchored at one end to the front edge of the flat-bed of the sewing machine, whereby the tube extends rearwardly beneath the sewing machine flat-bed. The tube outlet port is adapted to be releasably engaged by a flexible waste conduit for gravity-borne discharge of cut fabric threads to a waste container.

7 Claims, 4 Drawing Sheets

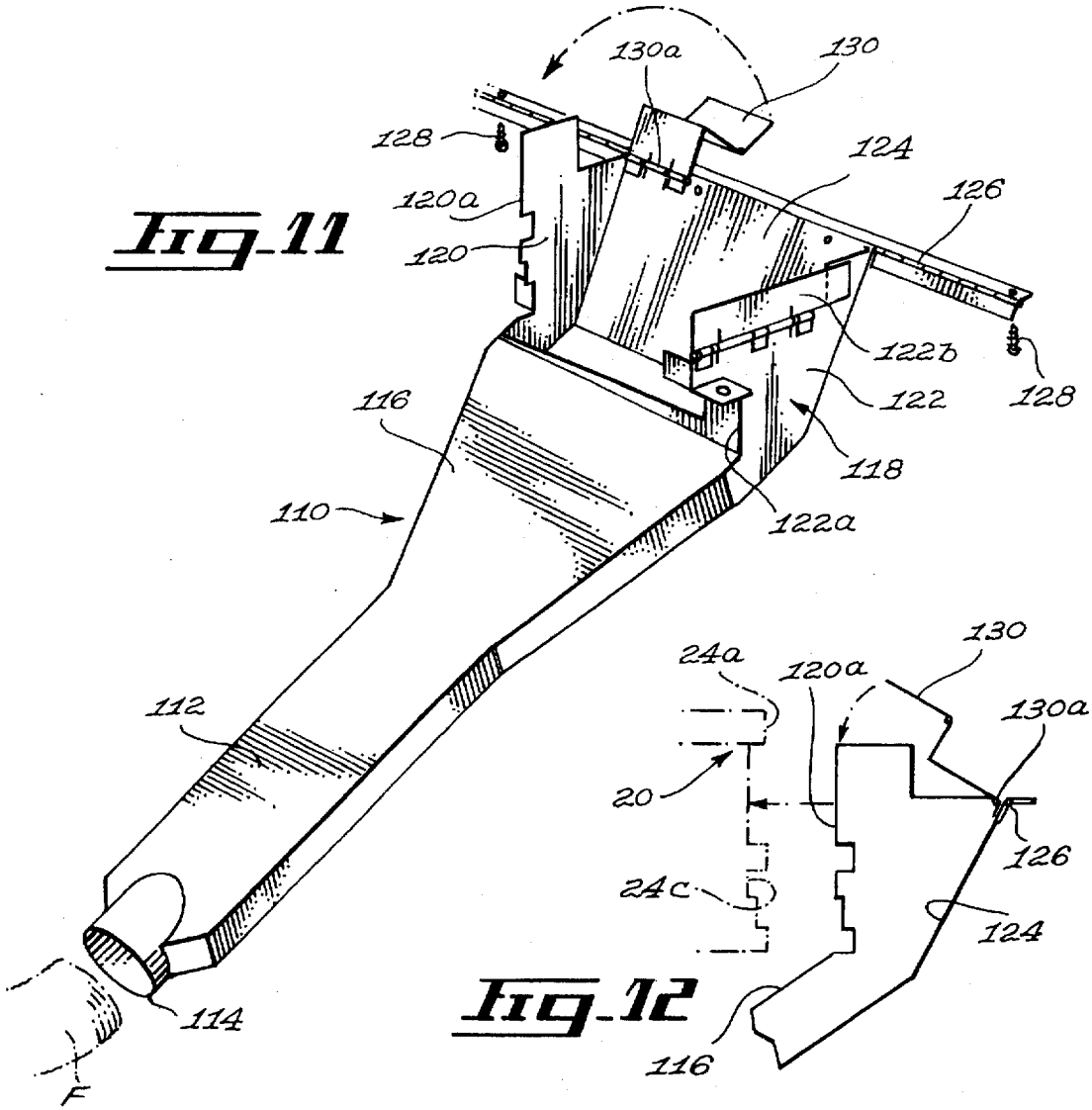
Fig. 11
Fig. 12
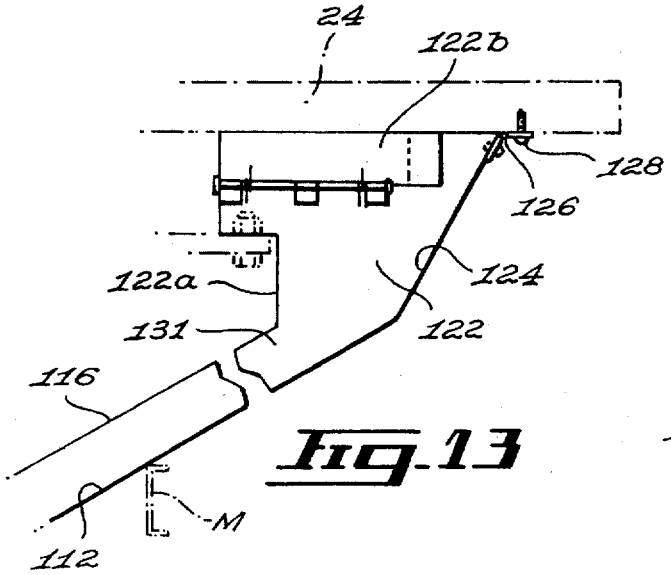
Fig. 13
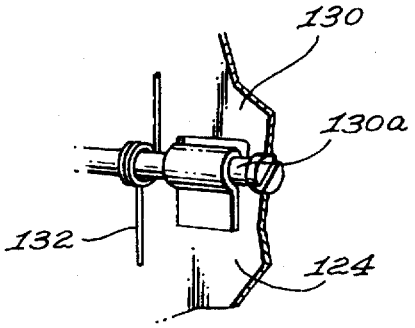
Fig. 14

VACUUM CLEANER FOR SEWING MACHINE

FIELD OF THE INVENTION

This invention relates to a waste fabric and lint collector, as well as to a cut thread collector, for use with a waste removal system for industrial overlock-type stitching sewing machines.

BACKGROUND OF THE INVENTION

Industrial sewing machines of the overlock stitching type are conventionally equipped with cutter knives for trimming away fabric edges. These cutter knives cut off uneven edges of fabric so that overlocked stitches cover the edges of one or more pieces of fabric that are sewn. Moreover, they are also usually provided with a chain cutter which cuts the leading and trailing ends of thread on the sewing machine.

Operation of the cutter knives in such overlock stitching type sewing machines generates a lot of lint-based air-borne particles that escape to the atmospheric environment of the workers operating these sewing machines. Such air-borne particles constitute a health hazard for the workers breathing the atmospheric air around these sewing machines, since these particles may engage into and clog and/or damage the lungs of the workers.

Accordingly, apparatuses for the collection and removal of cut threads and trimmed fabric from sewing machines have been implemented. Usually, these apparatuses are of the pneumatic waste removal type, for collecting the fabric waste and for conveying this waste to a waste container via one or more flexible waste conduits.

One problem with such prior art vacuum waste removal devices for sewing machines is that the fabric sheets moving over the sewing machine flat bed are somewhat transversely deformed under vacuum borne loads (which are also applied transversely of the fabric sheets), these vacuum borne loads being applied at the stitching needle area. Therefore, the efficiency of operation of the sewing machine workers is hampered, and/or the quality of workmanship can be compromised. Moreover, such prior art vacuum waste removal devices are still inefficient, in that they tend to leave some amount of dust in the immediate surrounding area of the stitching needle.

U.S. Pat. No 4,709,645 issued 1 Dec. 1987 to Templex, Inc. (joint inventors: Christopher and Lee Jones), discloses such a pneumatic type waste collection system for an industrial overlock stitching type sewing machine. A waste fabric and lint collector is provided, including a collecting box having a top mouth. The collecting box top mouth is custom shaped to conform with the configuration of the sewing machine around the effective cutting area between the cutter knives, so as to significantly restrict communication between the collection box and the ambient atmosphere as the collection box extends inmmediately beneath the cutting area between the cutter knives and proximal needles which generate the trimmed fabric and lint associated with sewing. Waste conduits interconnect the collection box and a waste container. The passage of compressed air through a venturi assembly creates a suction at the collection box for conveying the fabric debris to a waste container at a distance from the sewing machine.

In the Jones patent, the coupling duct of the collecting box is fixedly secured to the frame of the sewing machine by an annular clamp screwed to a bracket which is integral to the sewing machine frame.

OBJECTS OF THE INVENTION

The gist of the present invention is to improve the efficiency of operations of pneumatic type waste removal systems for overlock stitching type industrial sewing machines.

An important object of the invention is to substantially reduce the vacuum pressure borne deformation loads applied to the fabric sheets being stitched over the sewing machine flat bed, when a sewing machine vacuum cleaning device is operated about the stitching needle area.

SUMMARY OF THE INVENTION

Accordingly with the object of the invention, there is disclosed a waste fabric and lint collector for use with an overlock stitching type sewing machine, the sewing machine having a main frame with an upwardly opening trimmed fabric and lint outlet, the collector consisting of: (a) a collector box, including a front wall, two opposite lateral side walls, and top and bottom walls, a large see-through window forming part of said front wall thereof; (b) pivotal means, for pivotally mounting in a releasable fashion said collector box to the sewing machine frame, wherein the front portion of said trimmed fabric and lint outlet is substantially closed by said collector box; (c) a tubular coupling member, having an inner end portion of a shape complementary to that of the top wall of said collector box, for releasably interlocking engagement therewith, and an outer end portion, for releasably coupling with a complementary flexible air suction conduit for discharge of the lint to a waste container.

Preferably, there is further included a transparent guard plate, downwardly depending from said collector box ahead thereof, said guard plate positioned in the line of sight between the sewing machine needle and the eye of the operator for shielding the operator eye against accidents from operation of the sewing machine.

Advantageously, said pivotal means consists of a pivotal rod, pivotally engaging through bores made at the top rear portion of said lateral side walls of the collector box, and adapted to engage corresponding ears on the sewing machine frame.

Preferably, said guard plate includes a first upper vertical portion, and a second downwardly forwardly inclined portion, for providing utmost eye protection to the operator.

The invention also relates to the combination of a waste fabric and lint collector and a cut thread chute assembly for use with an overlock stitching type sewing machine, the sewing machine having a main frame with an upwardly opening trimmed fabric and lint outlet, the collector consisting of: (a) a collector box, including a front wall, two opposite lateral side walls, and top and bottom walls, a large see-through window forming part of said front wall thereof; (b) pivotal means, for pivotally mounting in a releasable fashion said collector box to the sewing machine frame, wherein the front portion of said trimmed fabric and lint outlet is substantially closed by said collector box; (c) a tubular coupling member, having an inner end portion of a shape complementary to that of the top wall of said collector box, for releasably interlocking engagement therewith, and an outer end portion, for releasably coupling with a complementary flexible air suction conduit for discharge of the lint to a waste container; and the chute consisting of: —an elongated tubular member, having an enlarged transversely opening mouth at one end, and a smaller axially opening outlet port at the opposite end, wherein said tubular member forms a generally funnel-shape body; —anchoring means, for anchoring said one end of said elongated tubular member to the front edge of the flat-bed of the sewing machine, whereby said funnel-shape body extends rearwardly beneath the sewing machine flat-bed; said tubular member outlet port adapted to be releasably engaged by a flexible waste conduit for gravity-borne discharge of cut fabric threads to a waste container.

Preferably, there would then be included flap members, carried by said tubular member one end, and being custom-shaped for complementarily fitting against the registering front portion of the sewing machine frame. Preferably also, one of said flap members includes spring biasing means, for frictionally interlocking said one of said flap members to the sewing machine frame so as to prevent accidental release therefrom of said chute.

BRIEF DESCRIPTION OF THE DRAWINGS

FIG. 11 is a perspective view of the preferred embodiment of the funnel-shaped cut threads collector according to the invention, showing in phantom lines the waste outlet flexible conduit;

FIG. 12 is a fragmentary schematic side edge view of the cut threads collector of FIG. 11, and of a corresponding part of the sewing machine illustrated in phantom lines, suggesting that the marginal edges thereof are custom-shaped to conform with the registering contour of the industrial overlock stitching type sewing machine illustrated in phantom lines;

FIG. 13 is a partly broken schematic side edge view of the cut threads collector of FIG. 11, suggesting how this collector is attached to the underface of the sewing machine illustrated fragmentarily in phantom lines; and FIG. 14 is an isometric view of the return spring assembly for the closure flap forming part of the cut threads collector of FIG. 11.

DETAILED DESCRIPTION OF THE EMBODIMENTS OF THE INVENTION

Figure 1:
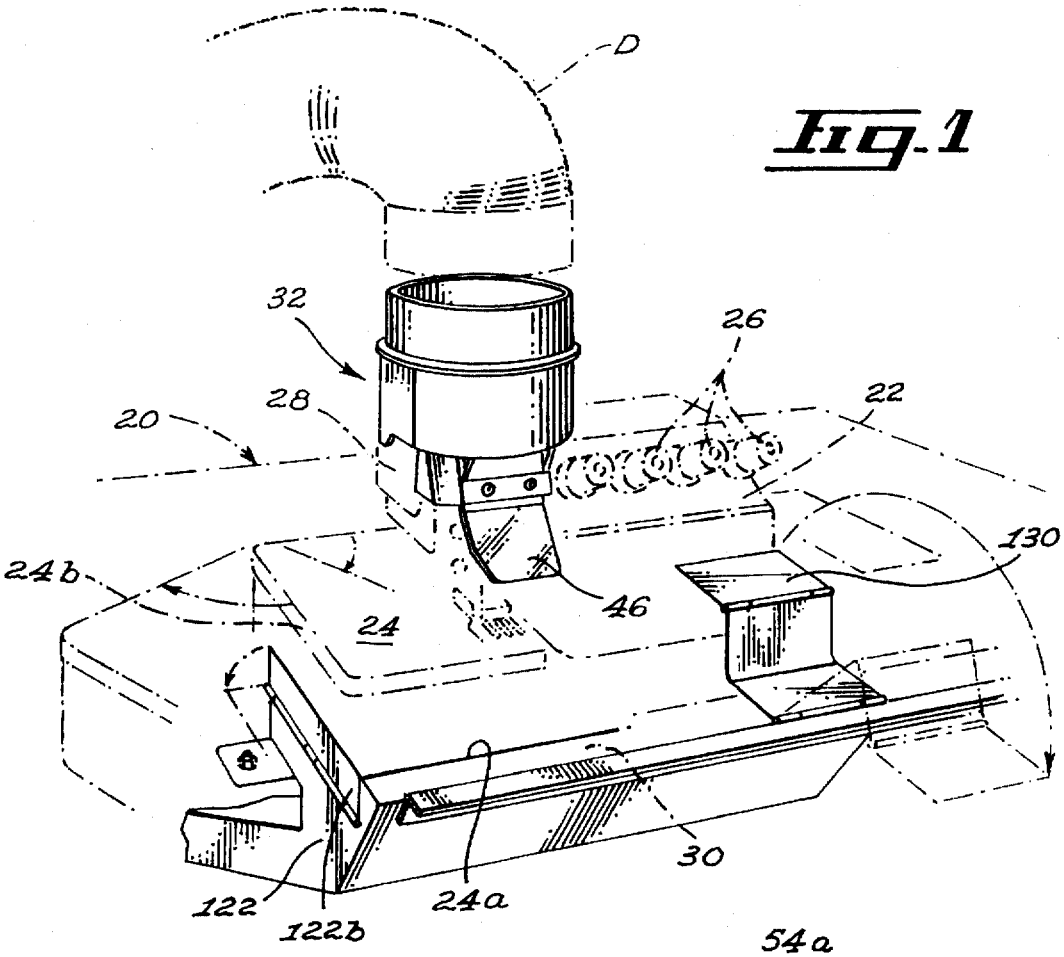
FIG. 1 is a partly schematic, perspective view of an industrial sewing machine of the overlock stitching type, illustrated in phantom lines, together with a first embodiment of waste fabric and lint collector and cut threads collector according to the present invention, both collectors being shown in full lines, and the waste fabric and lint collector being connected to an overlying flexible waste conduit also shown in phantom lines.
Figure 2:
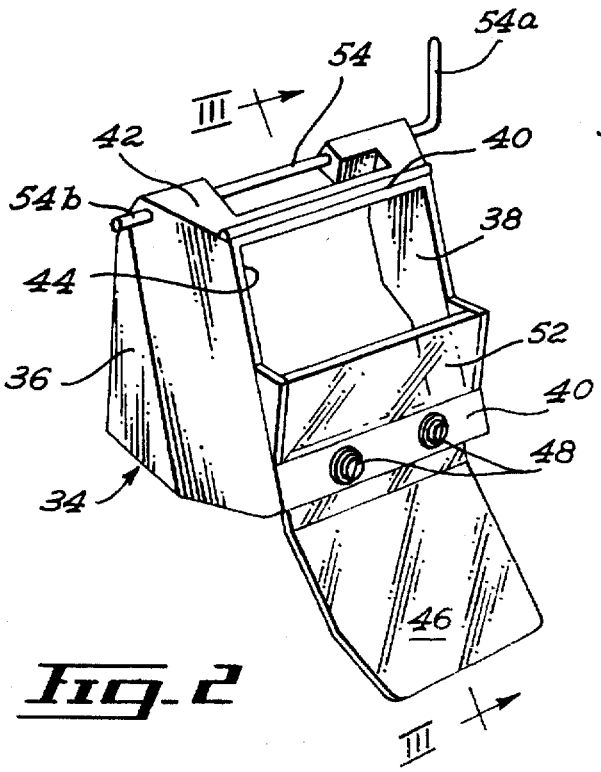
FIG. 2 is an enlarged perspective view of the collection box from the embodiment of waste fabric and lint collector of FIG. 1.

An industrial sewing machine 20 is shown schematically in phantom lines in FIG. 1. This industrial sewing machine 20 conventionally includes a main frame 22 having a flat-bed 24, for supporting the fabric material to be stitched, spool pins 26, a vertically reciprocatable needle (not shown), overlock stitching knives (not shown), and a chain cutter (not shown). The horizontal flat-bed 24 includes a front edge **24*a* and a lateral side edge 24*b*. The sewing machine includes a first debris outlet 28, in register with the cutter knives of the overlock stitching machine, for upward escape of waste trimmed fabric and lint generated by said cutter knives; and a second debris outlet 30**, for downward gravity-borne escape of waste cut threads generated by the chain cutter.

Figure 3:
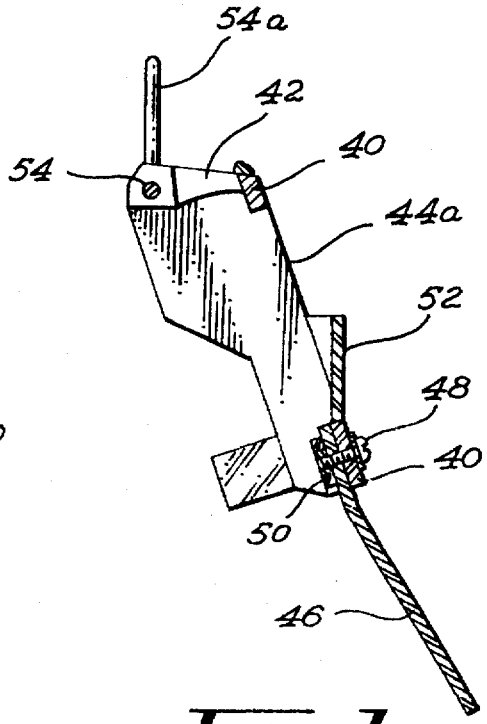
FIG. 3 is a sectional view taken along line III—III of FIG. 2.
Figure 4:
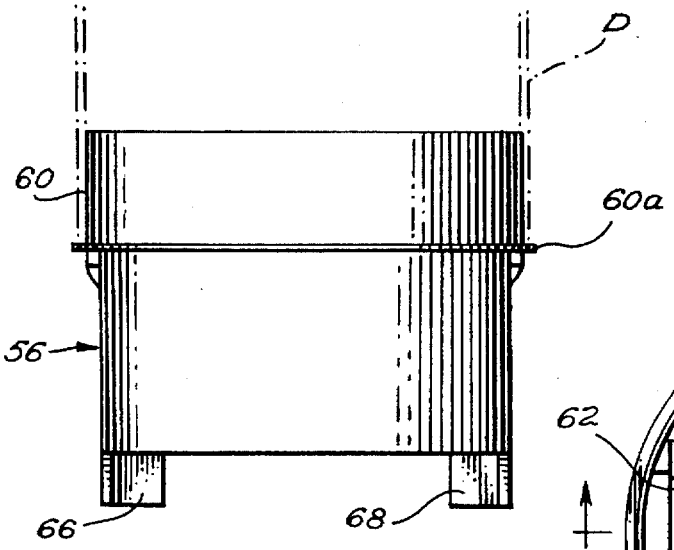
FIG. 4 is an enlarged elevational view of the coupling forming part of the embodiment of waste fabric and lint collector of FIG. 1.
Figure 6:
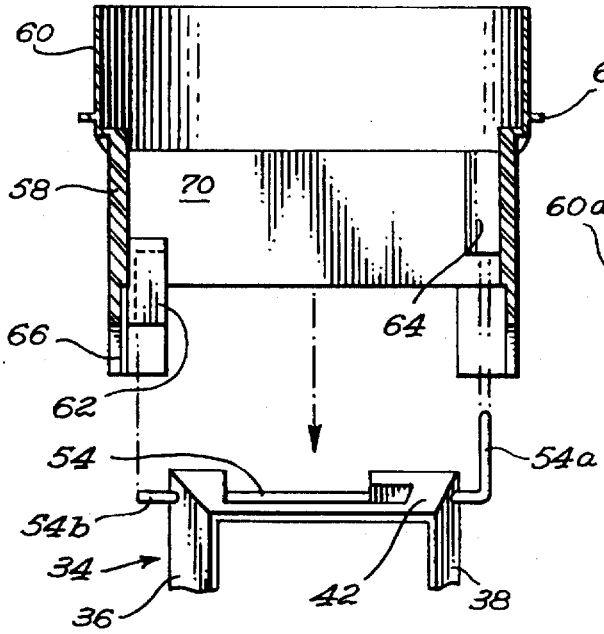
FIG. 6 is a sectional view taken along line VI—VI of FIG. 5, and further showing in fragmentary view the first embodiment of waste fabric and lint collector being detached from the coupling.
Figure 7:
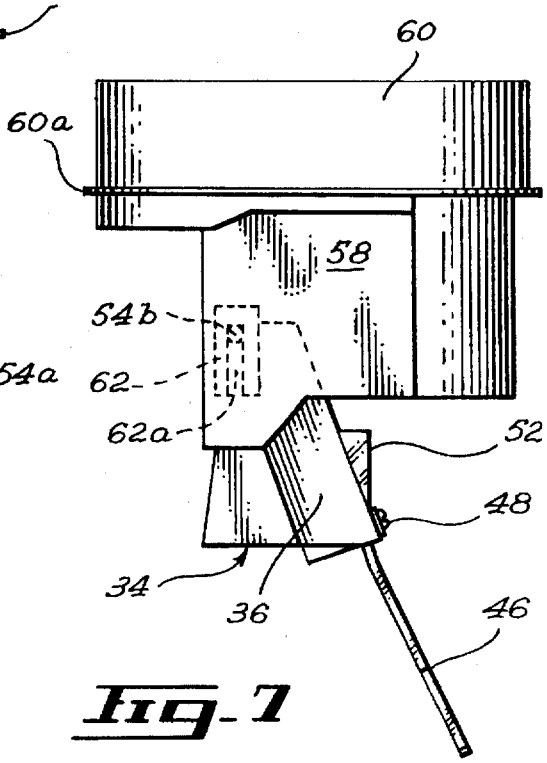
FIG. 7 is a side elevational view of the elements of FIG. 6, but with the waste fabric and lint collector being attached to its coupling.

A first embodiment of waste fabric and lint collector 32 is illustrated in FIGS. 1 and 6–7 of the drawings. The collector 32 includes a collector box 34, having two lateral side walls 36, 38, a front wall 40, and a top wall 42. A large open window 44 is formed in the front wall 40 of the collector box 34, for see-through capability. Preferably, a first transparent guard plate 46 is edgewisely anchored by screws 48 and nuts 50 to the bottom end of front wall 40, and is forwardly downwardly inclined relative to the general plane of the front wall 40. Preferably also, a second transparent guard plate 52 is edgewisely anchored by the same screws and nuts 48, 50, to the bottom end of front wall 40, and is forwardly upwardly inclined relative to the general plane of the front wall 40; the top edge of second transparent wall 52 being spaced from the top portion of front wall 40, wherein window 44 remains free of a transparent wall for an upper portion thereof at **44*a* (FIG. 3). Accordingly, a somewhat convex transparent wall surface 46, 52**, is defined, for see-through capability.

According to an important feature of the invention, the collector box 34 is to be pivotally mounted relative to the frame 22 of the sewing machine 20 by a pivotal axle 54 pivotally extending through the top wall 42 and transversely of the top portion of lateral side walls 36, 38. Pivotal axle 54 is preferably integral to top wall 42 and preferably includes an elbowed end portion **54*a*, projecting outwardly from side wall 38, so that rotation of elbowed tab 54*a* will rotate the whole collector box 34. Pivotal axle 54 also includes a second straight end portion 54*b*, projecting outwardly from side wall 36**, for a purpose later set forth.

As illustrated in FIGS. 4 to 7 of the drawings, the waste fabric and lint collector 32 further includes a tubular collar member 56, adapted to operatively interconnect the collector box 34 and a flexible tubular waste duct D (FIG. 1) from a standard industrial vacuum cleaner. Collar member 56 is preferably of generally cylindrical shape, having a main thick inner portion 58 and a radially enlarged thinner outer portion 60. Outer portion 60 includes an integral radially outturned annular lip **60*a* proximate the inner portion 58, for radially outward axial abutting engagement thereagainst of the mouth of flexible waste conduit D. Inner portion 58 further includes a pair of integral radially inturned ear members 62, 64, on opposite sides of the collar member 56. Ear members 62, 64, are complementary to pivotal axle end portions 54b, 54a, respectively, for releasable friction fit interengagement. More particularly, ear member 62 forms a socket of generally U-shape in cross-section, defining a radially inwardly opening channel 62a having a bottom mouth for engagement by the axle end portion 54b. Ear member 64 forms an axial passageway 64a for axial frictional engagement by elbowed tab 54a; passageway 64a does not need to open radially inwardly as with ear member 62. Ear member 64 is axially offset relative to ear member 62, so as to be closer to coupling portion 60**.

As suggested in FIG. 6, collector box 34 is sized relative to the inner portion 58 of collar member 56 to releasably fit snugly inside the collar inner portion 58, wherein upon axial displacement of collector box 34 toward inner collar portion 58, pivot axle end portion 54b will slidingly transversely engage frictionally (but releasably) into channel 62a of the collar ear member 62, whereas pivot axle elbowed tab 54a will axially engage slidingly and frictionally (but releasably) into passageway 64a of the collar ear member 64. Preferably, right-angle guide brackets 66, 68, integrally project axially from collar inner portion 58, in register with ear members 62, 64, to guide the pivotal axle end portions 54a, 54b, into the ear members.

Figure 5:
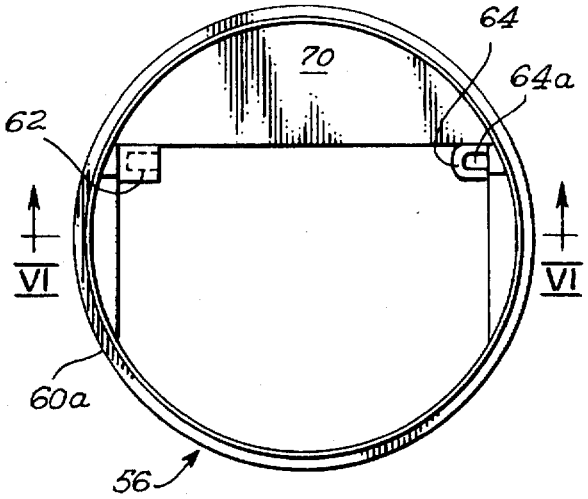
FIG. 5 is an end view of the coupling of FIG. 4.

As shown in FIGS. 5 and 6, there is also preferably provided inside the collar inner portion 58 a thick semi-circular panel 70 integrally mounted transversely thereof and spacedly proximate ears members 62 and 64. Panel 70 is designed to substantially close the area of the inner mouth of collar 56 exteriorly of the collector box 34, so as to substantially prevent accidental backflow of dust particles from the flexible waste duct D.

Figure 8:
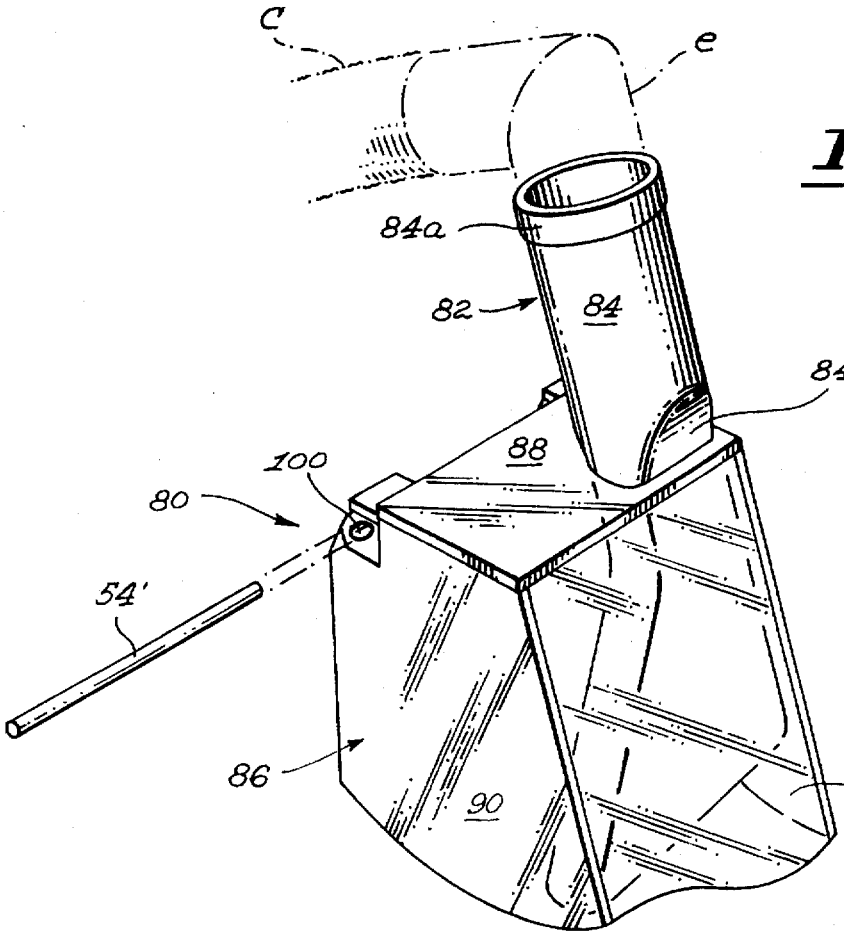
FIG. 8 is a perspective view of a second embodiment of waste fabric and lint collector and associated coupling, with the pivotal mount of the collector being axially removed from the axle thereof for clarity of the view, all shown in full lines, together with a flexible waste conduit attached thereto being shown in phantom lines.
Figure 9:
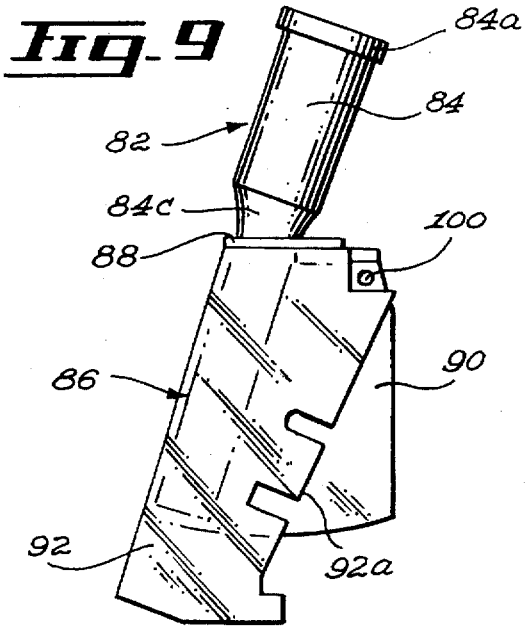
FIG. 9 is a side edge view of the full line elements of FIG. 8.
Figure 10:
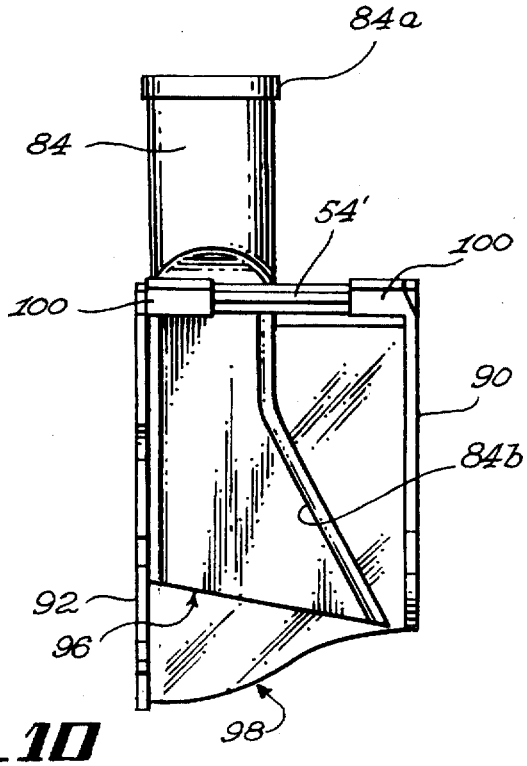
FIG. 10 is a front elevational view of the full line elements of FIG. 8.

A second embodiment of collector box and collar assembly, 80, is illustrated in FIGS. 8 to 10 of the drawings. Assembly 80 is for use with a waste conduit C having a rigid right-angle end part e. Coupling 82 of assembly 80 consists of a rigid tubular body 84 having a rimmed circular outer end mouth 84a, for engagement by the mouth e of waste conduit C, an enlarged inner end mouth part 84b, and a narrowed intermediate neck part 84c. Collector box 86 of assembly 80 is generally box-shaped, with a top wall 88, two lateral side walls 90, 92, a rear wall 94, a front opening 96 and a bottom mouth 98. Coupling 82 and collector box 86 operatively interconnect with one another by engagement of the tubular body intermediate neck part 84c through a complementarily-shaped opening in the top wall 84 of collector box 86. A pivotal axle 54' extends through bored ears 100 made in the collector box side walls 90, 92, in register with top wall 88, with pivotal axle 54' being longer than the width of the collector box so that both end portions of pivotal axle 54' project outwardly from the collector box for pivotal engagement with conventional ears (not shown) on the frame 22 of the sewing machine 20. The front edge 92a of side wall 92 has an irregular shape that is custom-shaped to fit the contour of the sewing machine.

Both embodiments of collector box and coupling assemblies 32, 80, constitute an interface between the waste trimmed fabric and lint outlet of the sewing machine 20 and the waste conduit of the vacuum cleaner machine. This interface provides a proper air channel for promoting flow of waste particles to the waste conduit without substantially escaping into ambient atmospheric air. It is not a completely air-tight interface, but it is a very good one at a very low cost.

FIGS. 11 to 14 disclose a preferred embodiment of collector and coupling assembly 110 for connecting to the second debris outlet 30, for downward gravity-borne escape of waste cut threads generated by the chain cutter of the sewing machine 20. Alternately, assembly 110 could be operatively coupled at its downstream end to a vacuum cleaning machine, for promoting downward vacuum pressure borne escape of waste cut threads over and above gravity borne forces. Assembly 110 includes a main rigid tubular member 112, e.g. of rectangular cross-section as shown, having an outer tapered nozzle 114 for frictional releasable flow-through engagement with a flexible waste duct F, and an enlarged funnel-shape inner end portion 116 opposite nozzle 114. As suggested in FIG. 13, tubular member 112 is destined to extend beneath the flat-bed 24 of the sewing machine 20 in downwardly rearwardly inclined fashion. Integral to the enlarged mouth of the funnel shape portion 116, there is transversely mounted a box-like chute 118 having two lateral side walls 120, 122, and a rear inclined wall 124. To the top edge of the chute 118 is fixedly mounted an elongated piano hinge joint 126, to be releasably anchored by screws 128 to the underface of the flat-bed 24 of the sewing machine 20. Accordingly, the inclination of chute 118 is self-positioning due to the piano hinge joint 126. A flow-through passageway 130, e.g. of rectangular cross-section, is formed at the bottom of chute 118, for free access into the funnel-shape tube 116.

Hence, as the waste cut threads fall under gravity-borne forces into chute 118, they slide along the slope of inclined rear panel 124 which direct same through the outlet port passageway 130 for engagement into funnel shape tube 116. Due to the inclination of tube 116, the waste cut threads slide downwardly into tube part 112, through outlet port 114 and into flexible waste conduit F for discharge into a refuse container.

As suggested in FIG. 12, the front edge 120a, 122a, of the side walls 120, 122, of the chute 118 are custom-shaped to fit complementary contour of the front wall 24c of the sewing machine 20. A spring loaded flap 130 is pivotally mounted at pivot means 130a to the top edge of sloped chute wall 124, parallel to piano hinge 126, and is biased by the return spring 132 to close a fraction of the top mouth of the chute 118, upon the chute 118 being installed beneath the sewing machine flat-bed 24. Again, the purpose of this spring-loaded flap 130 is to partially close the top mouth of the chute 118, in such a way that only a mouth area of a size substantially corresponding to the outlet port area of the waste cut threads outlet port of the sewing machine will remain. The top edge portion 122b of the chute side wall 122 will preferably form a short hinged plate, to transversely pivot if required yieldingly to conform to a specific sewing machine frame shape upon installation of the waste cut threads collector assembly.

It is envisioned that the tubular member 112 be positioned immediately above a cross-member strut M (FIG. 13) of the sewing machine frame 22, to be supported by same.

It is noted that with the present waste collector, the fabric material moving over the sewing machine flat bed 24 during stitching operations will not be substantially deformed (or very little) by overpressure or underpressure vacuum forces, having due consideration to the quantitative control of vacuum forces generated by the vacuum cleaning machine. Accordingly, this overcomes one major drawback of conventional sewing machine vacuum cleaner devices, since it will not hamper the handling of the fabric sheets by the sewing machine operator, thus resulting in enhanced efficiency of the sewing machine.

It is further noted that with the present design and relative location of the collection box relative to the sewing machine stitching needle area, substantially all of the dust particles located in the immediate surrounding area of the stitching needle will be removed from the flat bed area under correspondingly channeled vacuum borne forces. Therefore, a more thorough cleaning job of the sewing machine debris material will be performed by the present sewing machine vacuum cleaning device, compared to existing prior art vacuum cleaning device.

The embodiments of the invention, in which an exclusive property or privilege is claimed, are defined as follows:

1. A waste fabric and lint collector for use with an overlock stitching type sewing machine, the sewing machine of the type having a main frame with an upwardly opening trimmed fabric and lint outlet, the collector consisting of:

(a) a collector box, including a front wall, two opposite lateral side walls, and top and bottom walls, a large see-through window forming part of said front wall thereof;

(b) pivotal means, for pivotally mounting in a releasable fashion said collector box to the sewing machine frame, wherein the front portion of said trimmed fabric and lint outlet is substantially closed by said collector box;

(c) a tubular coupling member, having an inner end portion of a shape complementary to that of the top wall of said collector box, for releasably flow-through interlocking engagement therewith, and an outer end portion, for releasably flow-through coupling with a complementary flexible air suction conduit for discharge of the lint to a waste container.

2. A waste fabric and lint collector as defined in claim 1, further including a transparent guard plate, downwardly depending from said collector box ahead thereof, said guard plate positioned in the line of sight between the sewing machine needle and the eye of the operator for shielding the operator eye against accidents from operation of the sewing machine.

3. A waste fabric and lint collector as defined in claim 2, wherein said guard plate includes a first upper vertical portion, and a second downwardly forwardly inclined portion, for providing utmost eye protection to the operator.

4. A waste fabric and lint collector as defined in claim 1, wherein said pivotal means consists of a pivotal rod, pivotally engaging through bores made at the top rear portion of said lateral side walls of the collector box, and adapted to engage corresponding ears on the sewing machine frame.

5. In combination, a waste fabric and lint collector and a cut thread chute assembly for use with an overlock stitching type sewing machine, the sewing machine having a main frame with an upwardly opening trimmed fabric and lint outlet, the collector consisting of:

(a) a collector box, including a front wall, two opposite lateral side walls, and top and bottom walls, a large see-through window forming part of said front wall thereof;

(b) pivotal means, for pivotally mounting in a releasable fashion said collector box to the sewing machine frame, wherein the front portion of said trimmed fabric and lint outlet is substantially closed by said collector box;

(c) a tubular coupling member, having an inner end portion of a shape complementary to that of the top wall of said collector box, for releasably interlocking engagement therewith, and an outer end portion, for releasably coupling with a complementary flexible air suction conduit for discharge of the lint to a waste container; and the chute consisting of:

an elongated tubular member, having an enlarged transversely opening mouth at one end, and a smaller axially opening outlet port at the opposite end, wherein said tubular member forms a generally funnel-shape body;

anchoring means, for anchoring said one end of said elongated tubular member to the front edge of the flat-bed of the sewing machine, whereby said funnel-shape body extends rearwardly beneath the sewing machine flat-bed; said tubular member outlet port adapted to be releasably engaged by a flexible waste conduit for gravity-borne discharge of cut fabric threads to a waste container.

6. A waste collector and chute assembly as defined in claim 5, further including flap members, carried by said tubular member one end, and being custom-shaped for complementarily fitting against the registering front portion of the sewing machine frame.

7. A waste collector and chute assembly as defined in claim 5, wherein one of said flap members includes spring biasing means, for frictionally interlocking said one of said flap members to the sewing machine frame so as to prevent accidental release therefrom of said chute.

* * * * *